US009205429B2

(12) United States Patent
Subbannavar et al.

(10) Patent No.: US 9,205,429 B2
(45) Date of Patent: Dec. 8, 2015

(54) REVERSIBLE CONVEYER ASSEMBLY FOR MILLING APPARATUS

(76) Inventors: Chaithanya B. Subbannavar, Bangalore (IN); Naveen H. C. Kumar, Bangalore (IN)

( * ) Notice: Subject to any disclaimer, the term of this patent is extended or adjusted under 35 U.S.C. 154(b) by 316 days.

(21) Appl. No.: 13/817,392

(22) PCT Filed: Oct. 27, 2010

(86) PCT No.: PCT/IN2010/000701

§ 371 (c)(1),
(2), (4) Date: Mar. 29, 2013

(87) PCT Pub. No.: WO2012/056462

PCT Pub. Date: May 3, 2012

(65) Prior Publication Data

US 2013/0200191 A1 Aug. 8, 2013

(51) Int. Cl.

| | |
|---|---|
| ***B02C 9/04*** | (2006.01) |
| ***B02B 3/00*** | (2006.01) |
| ***B02B 7/02*** | (2006.01) |

(52) U.S. Cl.

CPC ... *B02C 9/04* (2013.01); *B02B 3/00* (2013.01); *B02B 7/02* (2013.01)

(58) Field of Classification Search

CPC ..... B02C 9/04; B02C 11/04
USPC ..... 241/277; 198/675
See application file for complete search history.

(56) References Cited

U.S. PATENT DOCUMENTS 4,829,893 A 5/1989 Satake ..... 99/603

FOREIGN PATENT DOCUMENTS

| | | | |
|---|---|---|---|
| DE | 31 17 885 A1 | 1/1983 | ..... B02B 3/06 |
| DE | 10 2004 041 367 A1 | 3/2006 | ..... B02B 3/00 |
| EP | 0 427 504 A2 | 6/1990 | ..... B02B 3/00 |
| JP | 2006 000708 | 1/2006 | |

OTHER PUBLICATIONS

International Search Report and written opinion for PCT/IN2010/000701, Dated Aug. 16, 2011.

*Primary Examiner* — Mark Rosenbaum
(74) *Attorney, Agent, or Firm* — Brinks Gilson & Lione

(57) ABSTRACT

A reversible conveyor assembly, which comprises a screw conveyor having one or more projection means formed on both upper and lower portions of the screw conveyor. A conveyor flange has a guiding means and a groove that are engraved on upper portion of the conveyor flange.

10 Claims, 4 Drawing Sheets

REVERSIBLE CONVEYER ASSEMBLY FOR MILLING APPARATUS

CROSS REFERENCE TO RELATED APPLICATIONS

This application claims the benefit under 35 U.S.C. §371 of International Application No. PCT/IN2010/000701, filed on Oct. 27, 2010, International Publication No. WO 2012/056462 A1, which is incorporated by reference herein.

FIELD OF THE INVENTION

The present invention relates to milling machines, specifically vertical abrasive type milling machines for food grains. The present invention particularly relates to a reversible type conveyor assembly for the vertical abrasive type milling machine.

BACKGROUND OF THE INVENTION

Conveyor assembly with screw conveyor are commonly used in a milling machine such as vertical abrasive type milling machine, having a milling chamber for polishing or whitening food grains, in particular rice grains. In the vertical abrasive type milling machine, the food grains to be milled are freely supplied from a food grain feeding system to the vicinity of the screw conveyor, through which the food grains are supplied to the milling chamber. These food grains are conveyed by the screw conveyor for milling or whitening action, which takes place in the milling chamber formed by abrasive roll assembly and cylindrical screen assembly. The screw conveyor is configured as a supply hooper for the milling machine and is driven by a drive to feed the food grains.

In the conventional milling machines, the screw conveyor is mounted on a main shaft extending vertically and directly connected to the main shaft. The food grains from the screw conveyor hits the abrasive rolls in the milling chamber and milling action takes place inside the milling chamber. The milled food grains are collected at bottom of the milling chamber and discharged through a discharge disk. The constant friction due to movement of the food gains in the screw conveyor, wears out the screw conveyor after certain period of time. The utilization of worn-out screw conveyor affects overall performance and efficiency of the milling machine, and therefore it has to be replaced after the specific time.

With respect to the conventional conveyor assembly of the milling machine, it is necessary to replace the worn-out screw conveyor with fresh screw conveyor, as there is no possibility to extend the lifetime of screw conveyor after it wears out. Moreover, the conventional screw conveyors should be used in single direction, as the screw conveyor is directly coupled to the main shaft. Further, the replacement of worn-out screw conveyor increases installation time and cost of the milling machine. Therefore, it is desirable to provide an improved conveyor assembly for a milling machine, which is capable of overcoming the aforementioned drawbacks. The present arrangement of conveyor assembly helps to mount and use the screw conveyor in both the direction by reversing the screw conveyor without effecting performance of the machine, which doubles the life of the screw conveyor.

SUMMARY OF THE INVENTION

An object of the present invention is to provide a reversible conveyor assembly, which facilitates reversing of screw conveyor without effecting performance of a milling machine and also increases the life span of the screw conveyor.

Another object of the present invention is to provide a reversible conveyor assembly, which is efficient to use and simple in construction.

Yet another object of the present invention is to provide a reversible conveyor assembly, which minimizes installation time and also avoids replacement and installation cost of the screw conveyor.

According to one aspect, the present invention, which achieves the objectives, relates to a reversible conveyor assembly comprising a screw conveyor having one or more projection means formed on both upper and lower portions of the screw conveyor. A conveyor flange has a guiding means and a groove that are engraved on upper portion of the conveyor flange. The screw conveyor is securely assembled to the conveyor flange in such a way that the guiding means of the conveyor flange is arranged to contact the inner surface of circular projection of the screw conveyor for placing at least one of the projection means of the screw conveyor with the groove of the conveyor flange, which ensures axial alignment of both the screw conveyor and the conveyor flange. Such arrangement of conveyor assembly facilitates reversing of the screw conveyor without effecting performance of a milling machine and also increases the life span of the screw conveyor.

Furthermore, the projection means in both the upper and lower portions of the screw conveyor are configured to align with the groove of the conveyor flange, such that the screw conveyor is reversibly attached to the conveyor flange. The projection means are configured as circular ring on both the upper and lower portions of the screw conveyor. The guiding means and the groove are engraved as circular ring on the conveyor flange. The screw conveyor further comprises a set of helical screw elements formed on outer periphery of the screw conveyor for carrying a desired quantity of food grains, and a set of through holes provided on both the upper and lower portions of the screw conveyor. The through holes are circumferentially spaced with each other and placed in proximity to the projection means. When the screw conveyor is being rotated, the helical screw elements supply the food grains to a milling chamber of a milling machine in a rotary fashion.

Moreover, the conveyor flange further comprises an opening with a keyway slot supported by a set of supporting members for engaging into a main shaft of the milling machine, and a set of through holes are circumferentially spaced with each other and placed in proximity to the groove. The keyway slot in the opening of the conveyor flange locks with a key in the main shaft while inserting the main shaft, so that rotary movement of the main shaft is transferred to the conveyor flange, which drives and rotates the screw conveyor. The supporting members are formed on the upper portion of the conveyor flange to evenly distribute rotary motion from the main shaft to the conveyor flange. The screw conveyor is assembled with the conveyor flange by attaching a set of fastening means into appropriate through holes of the screw conveyor and the conveyor flange.

According to another aspect, the present invention, which achieves the objectives, relates to a vertical abrasive type milling machine comprising a bearing housing vertically mounted on a main structure of the milling machine. The bearing housing is associated with a rotary ring with a wear ring for connecting the rotary ring to the main structure. A main shaft is rotatably supported in the bearing housing by means of upper and lower bearings. The main shaft is mounted to a machine pulley that is connected to a motor pulley by means of conveying belts. A reversible conveyor assembly comprises a screw conveyor having one or more projection means formed on both upper and lower portions of the screw conveyor, and a conveyor flange having a guiding means and a groove that are engraved on upper portion of the conveyor flange. The screw conveyor is securely assembled to the conveyor flange in such a way that the guiding means of the conveyor flange is arranged to contact the inner surface of circular projection of the screw conveyor for placing at least one of the projection means of the screw conveyor with the groove of the conveyor flange, which ensures axial alignment of both the screw conveyor and the conveyor flange. The main shaft vertically extends to the conveyor flange through the screw conveyor, such that the conveyor flange is coupled to the main shaft by means of locking unit, which ensures co-linearity of axial centre of the conveyor assembly in relation to the main shaft.

In addition, the milling machine further comprises an inlet connecting member having an inlet chute associated with the screw conveyor that receives and feeds the food grains from the inlet chute into the milling chamber. A portion of the conveyor flange is touched against the lower bearing, when the conveyor flange is coupled to the main shaft.

BRIEF DESCRIPTION OF THE DRAWINGS

The invention will be discussed in greater detail with reference to the accompanying Figures.

DETAILED DESCRIPTION OF THE INVENTION

The present invention will be described herein below with reference to the accompanying drawings.

Figure 1A:
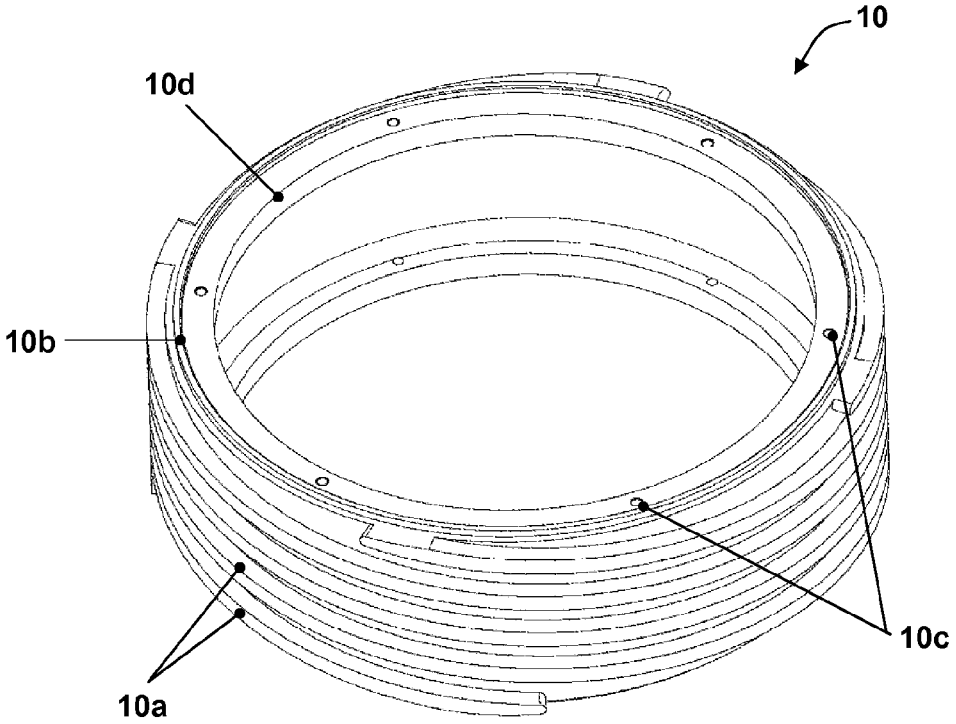
FIG. 1*a* illustrates a 3-dimensional view of a screw conveyor, in accordance with an exemplary embodiment of the present invention.
Figure 1B:
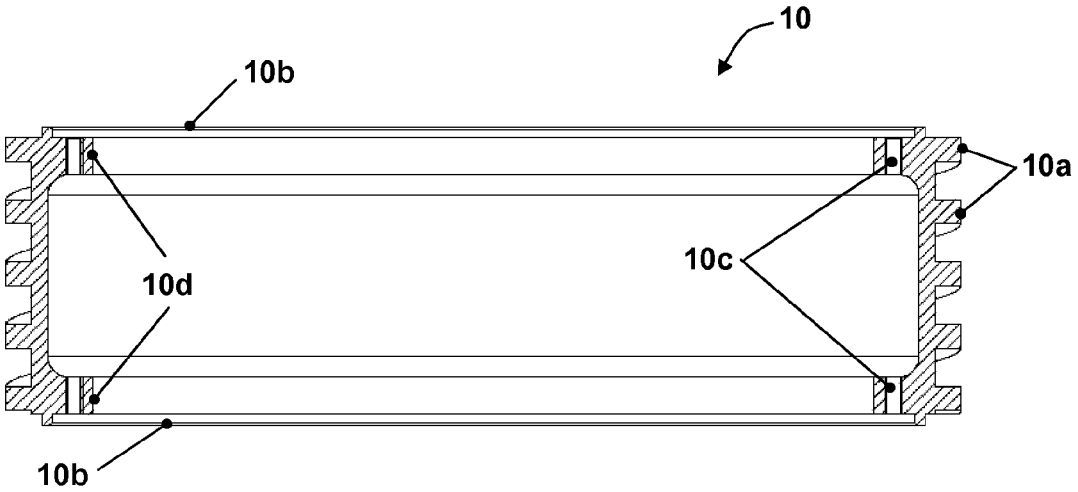
FIG. 1*b* illustrates a sectional front view of the screw conveyor, in accordance with an exemplary embodiment of the present invention.

Referring to FIG. 1*a*, a 3-dimensional view of a screw conveyor 10 is illustrated, in accordance with an exemplary embodiment of the present invention. The screw conveyor 10 is designed as a hollow ring-shaped feeder to deliver or supply a desired quantity of granular material such as food grains, into a milling process. In particular, the screw conveyor 10 supplies food grains to a milling chamber of a milling machine 100 for polishing or whitening the food grains by means of abrasive roll assemblies of the milling machine 100. The screw conveyor 10 is formed of a set of helical screw elements 10*a* formed on its outer periphery Once the screw conveyor 10 is being rotated, the helical screw elements 10*a* act as a channel to carry the food grains for milling operation in a rotary fashion.

In addition, the screw conveyor 10 is configured with a set of circular ring projections 10*b* on both upper and lower portions of the screw conveyor 10, respectively, which is clearly shown in FIG. lb illustrating a sectional front view of the screw conveyor 10, in accordance with an exemplary embodiment of the present invention. The screw conveyor 10 is composed of a set of threaded holes 10*c* provided on both upper and lower portions on the screw conveyor 10 to receive fasteners 30, which includes but are not limited to bolts or screws.

Hereafter, the fasteners or fastening means 30 and 31 are referred as bolts only for the purpose of explanation. The threaded holes 10*c* are circumferentially spaced with each other and placed in proximity to the ring projections 10*b* of the screw conveyor 10.

Figure 2A:
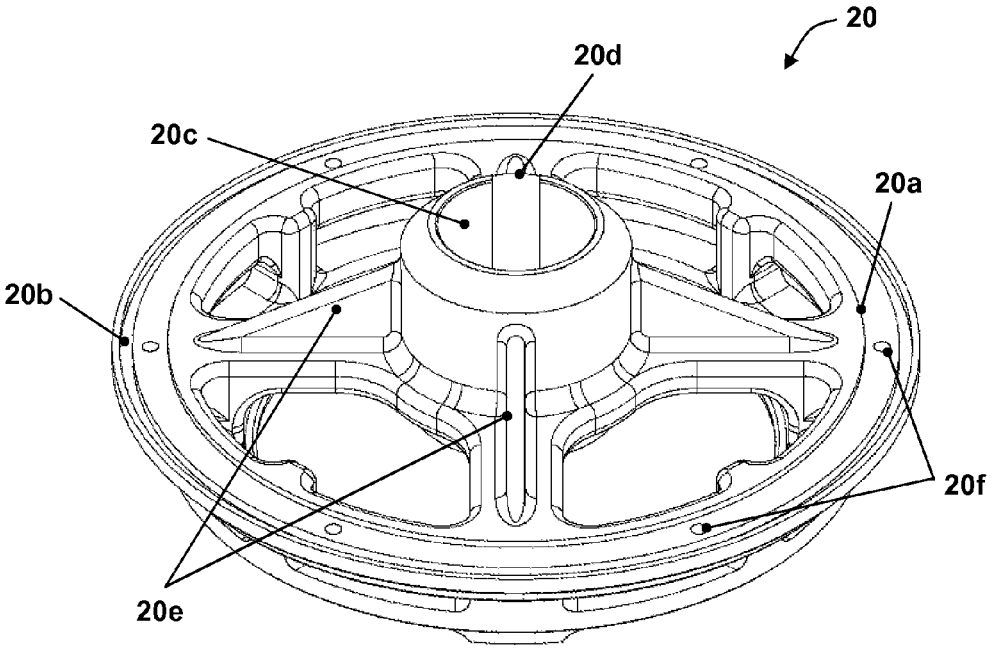
FIG. 2*a* illustrates a 3-dimensional view of a screw conveyor flange, in accordance with an exemplary embodiment of the present invention.
Figure 2B:
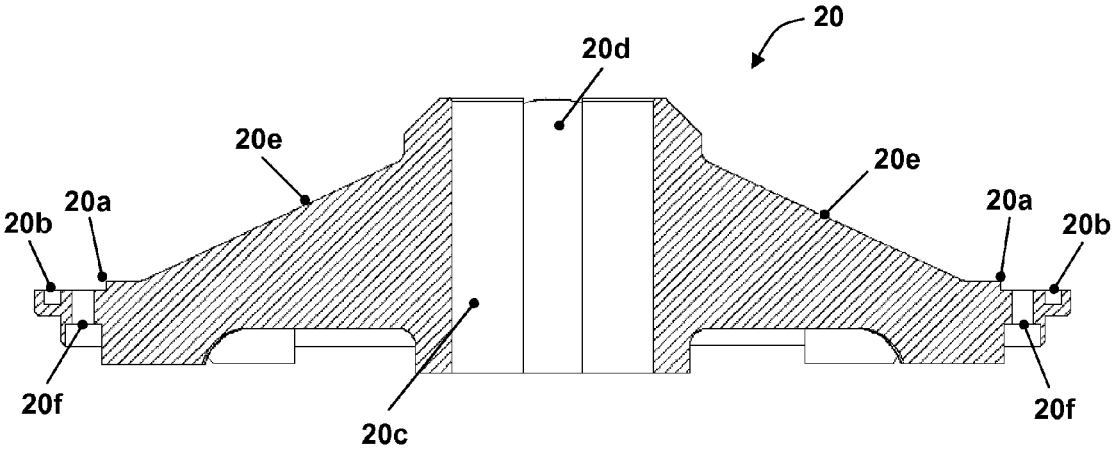
FIG. 2*b* illustrates a sectional front view of the screw conveyor flange, in accordance with an exemplary embodiment of the present invention.

FIGS. 2*a* and 2*b* respectively illustrate a 3-dimensional view and sectional front view of a screw conveyor flange 20, in accordance with an exemplary embodiment of the present invention. The screw conveyor flange 20 is designed for mounting the screw conveyor 10. The screw conveyor flange 20 consists of a circular guide 20*a*, a circular groove 20*b* and a central opening 20*c*. The circular guide 20*a* and the circular groove 20*b* are formed on the upper portion of the conveyor flange 20 to align the screw conveyor 10, when it is fixed to the conveyor flange 20. The circular guide 20*a* of the conveyor flange 20 can guide and locate the screw conveyor 10 to lock and engage one of the circular projections 10*b* of the screw conveyor 10 with the circular groove 20*b* of the conveyor flange 20.

The central opening 20*c* of the conveyor flange 20 is provided with a keyway slot 20*d* for receiving and engaging a main shaft 2 of the milling machine 100, with the conveyor flange 20. The central opening 20*c* is supported by a set of supporting members 20*e* formed on the upper portion of the conveyor flange 20, such that the rotary motion of the main shaft 2 is evenly distributed through out the conveyor flange 20. The screw conveyor flange 20 is composed of a set of holes 20*f* formed on it to receive the bolts 30. The holes 20*f* of the conveyor flange 20 are circumferentially spaced with each other and placed in proximity to the conveyor flange groove 20*b*.

Figure 3:
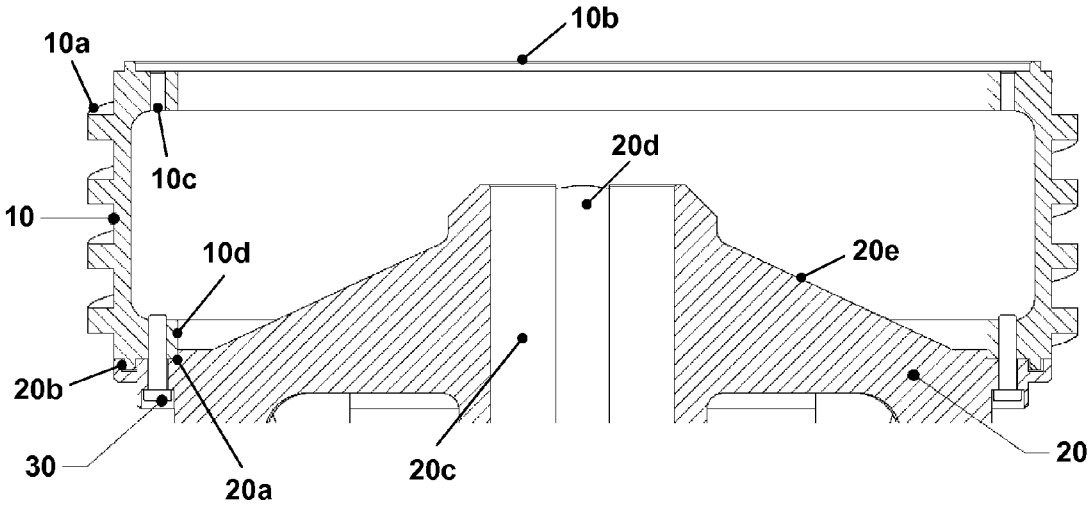
FIG. 3 illustrates a sectional view of a reversible conveyor assembly, in accordance with an exemplary embodiment of the present invention.

Referring to FIG. 3, a sectional view of a reversible conveyor assembly is illustrated, in accordance with an exemplary embodiment of the present invention. The reversible conveyor assembly composed of the screw conveyor 10 and the screw conveyor flange 20 is placed inside the milling chamber of the milling machine 100. The screw conveyor 10 is assembled to the screw conveyor flange 20 in such a way that one of the circular projections 10*d* of the screw conveyor 10 is engaged with the circular guide 20*a* of the conveyor flange 20, which locates and aligns axis of both the screw conveyor 10 and the conveyor flange 20. The circular projections 10*b* of the screw conveyor 10 sits within the circular groove 20*b* of the conveyor flange 20 with the help of circular guide 20*a*. Thereafter, the respective threaded holes 10*c* and the holes 20*f* of the screw conveyor 10 and the screw conveyor flange 20 are positioned, so that the screw conveyor 10 is fastened to the screw conveyor flange 20 by threading the bolts 30 into appropriate threaded holes 10*c* and the holes 20*f* of the screw conveyor 10 and the screw conveyor flange 20.

Since the circular projections 10*b*, 10*d* and the threaded holes 10*c* in both the upper and lower portions of the screw conveyor 10 are formed to align with the circular groove 20*b* and the holes 20*f* of the conveyor flange 20, the screw conveyor 10 can be reused by simply reversing and fastening it to the conveyor flange 20 using the bolts 30, even if one side of the screw conveyor 10 wears out. This arrangement of reversible conveyor assembly facilitates easy reversing of the screw conveyor 10 without effecting performance of the milling machine and also increases the life span of the screw conveyor 10. Such reversible conveyor assembly is efficient to use and simple in construction. Moreover, it also minimizes installation time and avoids replacement and installation cost of the screw conveyor 10.

Figure 4:
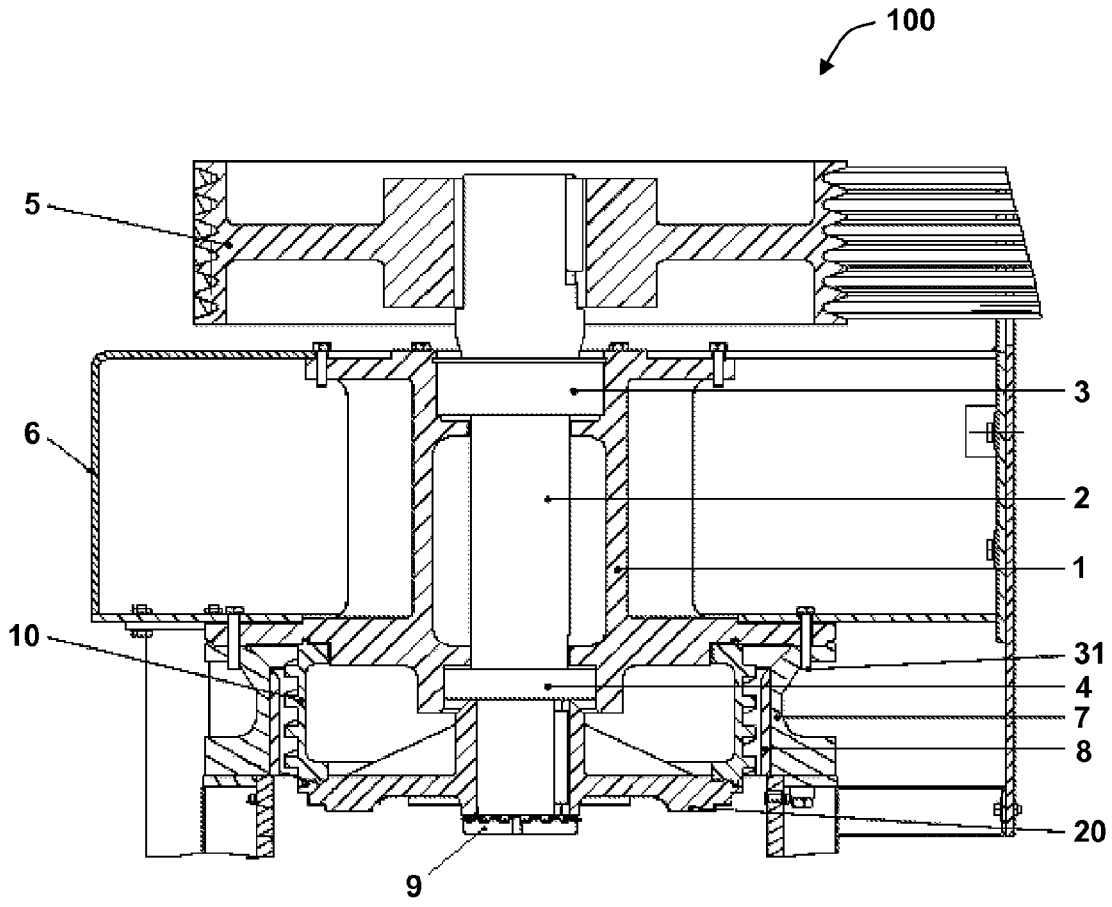
FIG. 4 illustrates a partial sectional view of a vertical abrasive type milling machine assembled with a reversible conveyor assembly, in accordance with an exemplary embodiment of the present invention.

Referring to FIG. 4, a partial sectional view of a vertical abrasive type milling machine 100 assembled with the reversible conveyor assembly is illustrated, in accordance with an exemplary embodiment of the present invention. The milling machine 100 includes a bearing housing 1, a reversible conveyor assembly, a vertical main shaft 2, a locking unit 9 and an inlet channel assembly. The bearing housing 1 can be vertically mounted on a main structure 6 of the milling machine 100. The main shaft 2 is rotatably supported in the bearing housing 1 by means of upper and lower bearings 3 and 4, respectively. The upper portion of the main shaft 2 is mounted to a pulley 5 that is connected to a motor pulley by means of V-belts, for rotary movement of the main shaft 2. The main shaft 2 extends vertically to the screw conveyor flange 20 of the reversible conveyor assembly.

In the reversible conveyor assembly, the screw conveyor 10 can securely be fixed onto the screw conveyor flange 20 by the bolts 30 threaded into the holes 10*c* of the screw conveyor 10, after aligning axis of the screw conveyor flange 20 and the screw conveyor 10 in relation to the main shaft 2 of the milling machine 100. The top surface of the screw conveyor flange 20 is touched against the lower bearing 4. The screw conveyor flange 20 can be coupled to the main shaft 2 by means of locking unit 9 such as ring nut. Once the main shaft 2 is inserted into the central opening 20*c* of the screw conveyor flange 20, the keyway slot 20*d* in the central opening 20*c* of the conveyor flange 20 is locked with respect of a key designed in the main shaft 2, so that the rotary motion of the main shaft 2 is transferred to the screw conveyor flange 20 with the help of key in the main shaft 2.

As the screw conveyor flange 20 is mounted to the main shaft 2, the conveyor assembly can be precisely coupled with rotary movement and axial centre of the main shaft 2. In particular, the screw conveyor flange 20 drives to rotate the screw conveyor 10 for feeding the food grains into the milling chamber, as it is fastened to the conveyor flange 20. The circular central opening 20*c* in the screw conveyor flange 20 ensures co-linearity of axis of the screw conveyor 10, the screw conveyor flange 20, the bearing housing 1 and the shaft 2. A rotary ring 7 is mounted on the bearing housing 1 by means of bolts 31 threaded into the rotary ring 7 for connecting the rotary ring 7 and the main structure 6 of the milling machine 100. A wear ring 8 is attached to the inner surface of the rotary ring 7. While reversing the screw conveyor 10, the present arrangement of reversible conveyor assembly helps in removing the worn-out wear ring 11. The milling machine 100 also comprises an inlet connecting member assembled with an inlet chute for feeding the food grains to be treated or milled. The screw conveyor 10 receives the food grains from the inlet chute, so that the food grains are supplied and introduced into the milling chamber through the screw conveyor 10. Finally, after milling the food grains inside the milling chamber, the food grains are discharged at the bottom side via a hopper.

The foregoing description is a specific embodiment of the present invention. It should be appreciated that this embodiment is described for purpose of illustration only. It is evident to those skilled in the art that although the invention herein is described in terms of specific embodiments thereof, there exist numerous alternatives, modifications and variations of the invention. It is intended that all such modifications and alterations be included insofar as they come within the spirit and scope of the invention as claimed or the equivalents thereof. Hence all variations, modifications and alternatives that falls within the broad scope of the appended claims comes under the gamut of the invention.

We claim:

1. A reversible conveyor assembly comprising:

a screw conveyor having one or more projection means formed on both an upper and a lower portions of the screw conveyor, where the screw conveyor comprises a plurality of helical screw elements formed on outer periphery of the screw conveyor for carrying a desired quantity of food grains; and a plurality of through holes provided on both the upper and the lower portions of the screw conveyor; and a conveyor flange having a guiding means and a groove that are engraved on an upper portion of the conveyor flange, where the conveyor flange comprises an opening with a keyway slot supported by a plurality of supporting members for engaging a main shaft of a milling machine; and a plurality of through holes that are circumferentially spaced with each other, the plurality of through holes are placed in proximity to the retaining groove, wherein the screw conveyor is securely assembled to the conveyor flange where the guiding means of the conveyor flange is arranged to contact the inner surface of the circular projection of the screw conveyor for placing at least one of the projection means of the screw conveyor with the groove of the conveyor flange, which ensures axial alignment of both the screw conveyor and the conveyor flange.

2. The assembly as claimed in claim 1, wherein the projection means in both the upper and the lower portions of the screw conveyor are configured to align with the groove of the conveyor flange, such that the screw conveyor is reversibly attached to the conveyor flange.

3. The assembly as claimed in claim 1, wherein the projection means are configured as a circular ring on both the upper and the lower portions of the screw conveyor.

4. The assembly as claimed in claim 1, wherein the guiding means and the groove are engraved as a circular ring on the conveyor flange.

5. The assembly as claimed in claim 1, wherein the through holes are circumferentially spaced with each other and placed in proximity to the projection means.

6. The assembly as claimed in claim 1, wherein when the screw conveyor is being rotated, the helical screw elements supply the food grains to a milling chamber of a milling machine in a rotary fashion.

7. The assembly as claimed in claim 1, wherein the keyway slot in the opening of the conveyor flange locks with a key in the main shaft while inserting the main shaft, so that rotary movement of the main shaft is transferred to the conveyor flange, which drives and rotates the screw conveyor.

8. The assembly as claimed in claim 1, wherein the supporting members are formed on the upper portion of the conveyor flange to distribute the rotary motion from the main shaft to the conveyor flange.

9. The assembly as claimed in claim 1, wherein the screw conveyor is assembled with the conveyor flange by attaching a plurality of fastening means into appropriate through holes of the screw conveyor and the conveyor flange.

10. A abrasive type milling machine, comprising:

a bearing housing mounted on a structure of the milling machine, the bearing housing is associated with a rotary ring with a wear ring for connecting the rotary ring to the structure;

a main shaft rotatably supported in the bearing housing by means of an upper and a lower bearings, the main shaft is coupled with a machine pulley that is connected to a motor pulley by means of a conveying belt; and a reversible conveyor assembly comprising a screw conveyor having one or more projection means formed on both an upper and a lower portions of the screw conveyor, where the screw conveyor comprises a plurality of helical screw elements formed on outer periphery of the screw conveyor for carrying a desired quantity of food grains; and a plurality of through holes provided on both the upper and the lower portions of the screw conveyor; and a conveyor flange having a guiding means and a groove that are engraved on an upper portion of the conveyor flange, where the conveyor flange comprises an opening with a keyway slot supported by a plurality members for engaging a main shaft of the milling machine; and a plurality of through holes that are circumferentially spaced with each other, the plurality of through holes are placed in proximity to the retaining groove, wherein the screw conveyor is assembled to the conveyor flange in such a way that the guiding means of the conveyor flange is arranged to contact the inner surface of the circular projection of the screw conveyor for placing at least one of the projection means of the screw conveyor with the groove of the conveyor flange, which ensures axial alignment of both the screw conveyor and the conveyor flange, and wherein the main shaft vertically extends to the conveyor flange through the screw conveyor, such that the conveyor flange is coupled to the main shaft by means of locking unit, which ensures co-linearity of axial center of the conveyor assembly in relation to the main shaft.

* * * * *

UNITED STATES PATENT AND TRADEMARK OFFICE

CERTIFICATE OF CORRECTION

PATENT NO. : 9,205,429 B2
APPLICATION NO. : 13/817392
DATED : December 8, 2015
INVENTOR(S) : Chaithanya B. Subbannavar et al.

It is certified that error appears in the above-identified patent and that said Letters Patent is hereby corrected as shown below:

In the Claims

In column 8, claim 10, line 1, after "a keyway slot supported by a plurality" insert --of supporting--.

Signed and Sealed this
Twenty-sixth Day of April, 2016

Michelle K. Lee

Michelle K. Lee
*Director of the United States Patent and Trademark Office*